United States Patent [19]

Sinka

[11] Patent Number: 4,845,846

[45] Date of Patent: Jul. 11, 1989

[54] RAZOR ADAPTOR

[76] Inventor: Laslo B. Sinka, 27 Santa Barbara Rd., Willowdale, Ontario, Canada

[21] Appl. No.: 175,492

[22] Filed: Mar. 30, 1988

Related U.S. Application Data

[63] Continuation-in-part of Ser. No. 7,140, Jan. 27, 1987.

[30] Foreign Application Priority Data

Jan. 24, 1986 [CA] Canada ..... 500367

[51] Int. Cl.[4] ..... B26B 14/42

[52] U.S. Cl. ..... 30/34.2; 30/90

[58] Field of Search ..... 30/34, 34.2, 90, 85, 30/123

[56] References Cited

U.S. PATENT DOCUMENTS 1,700,951 2/1929 Power et al. ..... 30/34.2

2,198,531 4/1940 Fulenwider ..... 30/34.2

2,275,810 3/1942 Weiland ..... 30/34.2

*Primary Examiner*—Frank T. Yost

*Assistant Examiner*—Willmon Fridie, Jr.

[57] ABSTRACT

A shaving implement which is a razor adaptor attached to a safety razor system having a blade assembly coupled to a handle—for skin and hair conditioning by constantly stretching and arching the skin ahead of the blade assembly in operation, whereby the skin is smoothened out and the hairs are lifted up from their hollows to suit the blades for an optimum shave. The adaptor comprises a skin stretching bar extending outwards in a spaced manner below and parallel to the blade assembly in an operating position. It could be flipped down to the handle to a resting position—for trimming purpose on a V-shape interconnecting arms hinged to a bracket extending from the associated channels between the flanges of the handle down to its neck and fixed to a clamp embracing the handle.

6 Claims, 1 Drawing Sheet

RAZOR ADAPTOR

This application is a Continuation-In-Part of pending prior Application Serial No. 07/007,140 filed Jan. 27, 1987 of Laslo B. Sinka for Razor Adaptor.

CROSS-REFERENCE TO RELATED APPLICATION

Canadian Patent Application No. 500,367 Cl.30, Sub.Cl.34, Div.5 filed Jan. 24, 1986 and issued to Canadian Pat. No. 1,227,628 on Oct. 06, 1987.

Priority was claimed and acknowledged 03/01/88.

BACKGROUND OF THE INVENTION

The invention relates to a razor adaptor, an implement, attached to a wet shaving system and is directed more particularly to provide a favorite skin and hair condition ahead of the blade cartridge for lifting up the hairs within their natural hollows to suit the blade(s) for high quality shaving.

PRIOR ART

No razor system up until now has had any provision for conditioning the skin, hair or beard ahead of the blade assembly during shaving to help the blade(s) by stretching and arching the skin so as to lift up the hairs or beards within their natural hollows for better shaving.

Recent improvement has been approached in a shaving system as described by Roger C. Edson in U.S. Pat. No. 3,593,416 which is a modified version of a conventional razor blade assembly.

The prior shaver such as above mentioned Edson's shaver has nothing common with present invention whatsoever. No identity between the two. The structure and the principle of Edson's device are exactly the same as of any conventional blade assembly and not as of this invented razor adaptor, as will be seen below. This adaptor could be attached to Edson's razor system too—at least to eliminate the fold of skin which may project between his blades.

The shaving head in Edson's device is pivotally mounted on a handle and having two blades facing each other by their edges and—depending on the direction of shaving—alternatly act as a shaver or as a guide to hold the other cutting edge at a proper cutting angle to shave. The blades face one another and are spaced apart sufficiently for a ridge of skin to be pressed between the edges and when one blade is drawn flatly across the skin as a guard and guide for the cutting edge of the other facing blade the latter is positioned so as to produce proper shaving angle therefor.

Furthermore, because Edson's guarding and shaving blade—like the guard and the blade(s) of all conventional cartridges—are integral parts of their blade assembly or shaving head and pivoting on a mutual axis, they equally share the pressure from the handle; they inevitably sink below the line of the skin surface under the slightest pressure and form an artificial indentation in the skin surface in which the hairs are retracted within their natural invagination or hollows at the apex of the epithelial cells around their folicles. After the shaving head or cartridge passes the hairs—and only then (when it is too late)—the artificially increased said hollows smoothen out and the hairs protrude back to their high position. The shaver then repeats the strokes, increases the pressure in desperation and producing rather more skin damage than better shaving.

To stretch the skin, a stretching bar must have a highly frictional surface and plenty of pressure to push the skin ahead. Edson's guarding blade—as all shaving blades on the market today—has a smooth surface and running backward and in an angle relative to the skin, meets no practical resistence to its movement. It slides over all the wrinkles and folds which may project between the blades of Edson's device, but not able to produce skin stretching or arching. If any skin stretching takes place in Edson's case, it is produced only by his shaving blade, because its front running edge encounters some resistance from the hairs being cut.

The backward running blade is called "guard" and "guide" all over in Edson's Patent to prevent digging in and cutting the skin and he never claims any skin stretching, arching or hair lifting function or ability of his device.

And finally, Edson's shaving razor must have cut into the skin in an upward motion—at least around the sharp contours of the face—and that was enough reason to prevent it from reaching the market for 17 years.

Other advances have been achieved with significant success in this field for a better system but non of them deals with skin or hair conditioning to help the blade(s) and the shaving is still a two hand job; a face making stuggle and a slow procedure—particularly under the jaw and around the neck. Furthermore, the blade(s)—particularly under an increased pressure—not only cut(s) the hair at a high point, but even the contour of said hollows and the tip of the wrinkles as well, resulting in irritation and skin damage.

SUMMARY OF THE INVENTION

An object of the present invention is to provide a device delivering the smoothest possible skin surface to the blade(s) for higher efficiency, more comfortable and easier shaving.

The theoretic ideal shaving would be: cutting the hairs at their very base. It could be done only if the hairs are lifted up to their highest position for optimum cut and having no pressure on the blade(s) at all, To achieve the above objective, the stretching bar of the present invention is coupled to the handle of a razor system and distributes most of the pressure from said handle onto the skin stretching bar. This bar runs parallel to and—in operation—ahead of the cartridge, which pivots on said handle and only a minimal fraction of said pressure is provided to said blade assembly not more than just enough to touch the skin. Pressure distribution control is mannual.

It is the combined effect of said heavy bar pressure and the minimal blade pressure that results in eliminating said hollows and wrinkles and in a maximum hair projection or hair lifting to suit the blade(s) for said ideal shave.

As a stretching bar—having a highly frictional surface—receiving most of the pressure from the handle, presses strongly onto the skin surface, it pushes the skin ahead and upward so, that the skin behind it is not only stretched, but forms an arcuate or arch shape. This action creates the favorite skin and hair condition commonly done by the professional barbers (to suit their single blade knife). The blade assembly then lifted up on the top of said arch and literally tends to glide rather than slide over a perfectly smooth surface, where the hairs are lifted up to their highest possible position for optimum cut. The first blade cuts closer, the second one the closest of all existing systems today.

With above and other objects in view, as will hereinafter appear, a feature of the present invention is the provision of a razor adaptor attached to a complete razor system. The system consists of a blade cartridge pivotally connected to a handle. Said adaptor comprises a skin stretching bar means outwardly extending in a spaced manner and—in operation—ahead of said cartridge and fixed to a V-shaped arm means hingedly attached to a pair of springy, flat, parallel arms. These arms constitute a bracket means perpendicularly fixed to a clamp means embracing said handle to couple the adaptor to said razor system. Said bracket means extends to and perches on the edge of said handle to provide a firm securement for the adaptor.

Contrary to the existing systems, this device is more effective in areas, where the skin is flacid, like under the jaw, around the neck and under the arms.

The friction of said stretching bar is important. It is even advisable to wash the soap off the skin—after the hairs are softened—and shave immediately to increase said friction for more efficient and comfortable shave.

Two of the secrets of quality shaving are: skin conditioning and slanted motion of the blade(s) or knife. Both carefully performed by the professional barbers and could be carefully done with the help of this invented adaptor.

For a medical shave, for trimming or shaving under the nose, said bar could be flipped down on said hinge to said handle and locked into its resting position automatically by the springy action of said bracket means.

The device is easy to use; simple in construction; it could be made entirely of plastic; production costs are low. The adaptor could be sold separately or just be dropped into a package of shaving goods or disposable razor systems for market promotion.

Furthermore, a potential demand exists for a highly efficient device, like this, particularly from those of all age categories having sensitive skin and can not use the present shaving systems because of skin irritation and have changed for electric shaver—regardles of its draw backs.

The above and other features of the invention, including various novel details of construction will now be more particularly described with reference to the accompanying drawings and pointed out in the claims.

It will be understood, that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which shown an illuatrative, preferred embodiment of the invention from which its novel features and advantages will be apparent.

In the drawings

DESCRIPTION OF THE PREFERRED EMBODIMENT

Figure 2:
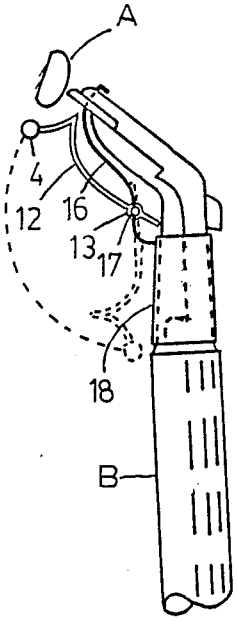
FIG. 2 is an exploded side view of the adaptor hingedly attached to a razor system (A and B). The bar member (4) is locked into an operating position. The dotted line illustrates the way by which said bar (4) can be flipped down to the handle (B) and locked into its trimming or resting position.
Figure 3:
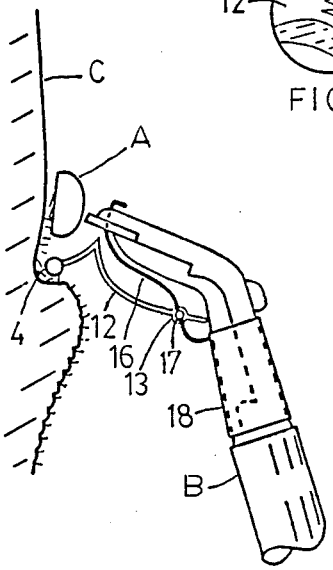
FIG. 3 illustrates the operating principle of the invention. In a side view the adaptor is attached to a razor system (A and B) in operation and in a related position to the skin (C) being shaved.
Figure 5:
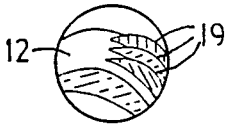
FIG. 5 is a magnified, perspective view of the fins and the arm of FIG. 4.
Figure 6:
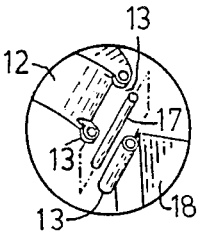
FIG. 6 is an exploded perspective illustration of the structure of the hinge and its components: the hinge eyelets and hinge pin connecting the arm and the clamp of FIG. 4 in a related position one to another.

Refering to the drawings, it will be seen that the illustrative razor adaptor comprises a skin stretching bar (4) having a highly frictional, fluted surface, coated with rubber or vinyl extending outwards in a spaced manner below and parallel to the blade assembly (A) pivotally connected to the handle (B) of a razor system to constantly stretch and arch the skin ahead of said assembly (A) to lift up the hairs within their natural hollows to suit the blade(s) for a better shaving; said bar (4) is fixed symmetrically to the free ends of an interconnecting, V-shaped arms (a) sharing a pair of hinge eyelets (c) at a suitable point close to its lower end—as specified later; a flat, springy material pair of parallel arms constituting a bracket (b) perpendicularly fixed to the top corners of clamp (e) embracing said handle (B) to attach the adaptor to said system; said bracket (b) is arched from said clamp (e) parallel one to another toward the connecting upper portion of said handle (B) and sharing a pair of hinge eyelets (c) at its crossing point on an imaginative line equally dividing the angle between said upper portion and said handle (B) at a suitable location which is slightly closer to the handle (B) and to its upper portion than to the original point of said dividing line. From this point the arms—forming said bracket (b)—are gradually changing their direction—suitably away from each other—toward said upper portion to follow its contour to perch on its edge in the associated channels between the flanges to secure a firm position for the adaptor; said hinge eyelets (c) on said V-shaped arms (a) fit inside of their counterparts (c) of bracket (b) and connected together by a hinge pin (d). On this hinge (c) said bar (4) could be moved away from said cartridge (A) down to said handle (B) when said bar (4) is not needed. For example: shaving under the nose upward, trimming or in some medical shavings. For this purpose the distance of said hinge eyelets (c) from the lower end of said V-shaped arms (a) is slightly longer than from said handle (B) and from said upper portion to lock said bar (4) into either an operating or a resting position by using the springy action of said bracket (b) and slightly shorter than the distance of said hinge eyelets (c) from the origin of said dividing line to provide an adequate clearance for the movement of said arms (a) during flipping said bar (4) up and down—as illustrated in FIG. 2 by the dotted line. The pressure distribution control is manual for personal preferences.

Figure 4:
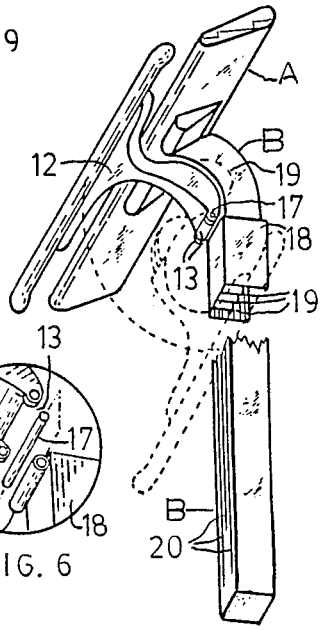
FIG. 4 illlustrates an exploded, perspective view of a modified embodiment of the razor adaptor hingedly attached to one type of various shape disposable razor systems. The dotted line illustrates the way by which said bar (4) can be flipped down from the cartridge (A) to the handle (B) into its trimming or resting position.

To hingedly attach the above described adaptor to one type of the various shape disposable razor systems, a modified embodiment may be used—as illustrated in FIG. 4—which comprises an arm (a) fixed to said bar (4) and attached by a hinge (c) and a hinge pin (d) to a clamp (e) embracing said handle (B) to couple the adaptor to said system. Said arm (a) and said clamp (e) have fins (f) facing said handle (B) to fit into the grooves in said handle (B) and to lock the adaptor into a firm position on said handle (B). The way of flipping said bar (4) up and down is illustrated by the dotted line in FIG. 4. This modified version of the adaptor could also be made entirelly of plastic and—because of low production costs—one adaptor could simply be dropped into a package of disposable systems for promotion alone.

Arm (a) could be formed to be hinged directly to said handle (B) having openings at a suitable point for this purpose. (Not illustrated.)

The embodiment of the invention in which an exclusive property or privilege is claimed are defined as follows:

1. A razor adaptor comprising a skin stretching bar means hingedly attached to a razor system wherein said razor system having a blade assembly pivotally coupled to a handle, said bar means being attached to said handle and extending outwards in a spaced manner below and parallel to said blade assembly in an operating position and being flippable up and down into either an operating or a resting position on a V-shaped interconnecting arm means fixed by a hinge and a hinge pin to a flat, springy pair of arms constituting a bracket means fixed to a clamp means embracing said handle to couple said adaptor to a razor system.

2. A razor adaptor in accordance with claim 1 in which said bar means has a surface portion perpendicularly fixed to the free ends of said V-shaped arm means; said bar surface being frictional, fluted and coated with a frictional material in the group consisting of rubber and vinyl and operative in shaving for constantly stretching and arching the skin surface to lift up the hairs within their natural hollows for an optimum shave.

3. A razor adaptor in accordance with claim 2 in which said V-shaped arm means has a pair of hinge eyelets provided at a point close to its lower end and operative for hingedly connecting to said bracket means whereby said bar means is flippable up or down.

4. A razor adaptor in accordance with claim 3 in which said bracket means fixed perpendicularly to the top corners of said clamp means and arched parallel toward the upper portion of said handle and having a pair of hinge eyelets operative to connect said V-shaped arm means at a selected point on an imaginative line equally dividing the angle between said handle and its upper portion to have said lower end of said V-shaped arm means to press hard against said handle and its upper portion—utilizing the springy action of said bracket means—and to lock said bar means into either an operating or a resting position, while providing an adequate clearance to the movement of said arm means across said dividing line during the flipping of said bar means up or down.

5. A razor adaptor in accordance with claim 4 in which said hinge pin connects said V-shaped arm means and said bracket means.

6. A razor adaptor in accordance with claim 5 in which said adaptor is attached to a disposable razor system and having said bar means perpendicularly fixed to an arm means hingedly attached to a clamp means embracing said handle to couple said adaptor to said razor system; said arm means and said clamp means having fins formed on lateral sides therein facing said handle for engaging with existing grooves in said handle so as to provide a firm securement to said adaptor.

* * * * *

UNITED STATES PATENT AND TRADEMARK OFFICE

CERTIFICATE OF CORRECTION

PATENT NO. : 4,845,846

DATED : 7/4/89

INVENTOR(S) : Laslo B. Sinka

It is certified that error appears in the above-identified patent and that said Letters Patent is hereby corrected as shown below:

On page 3, lines 27 - 28 of said Letter Patent could be easily done with the help of this invented adaptor.

From page 4, line 22 to page 5, line 18 inclusive

Figure 1:
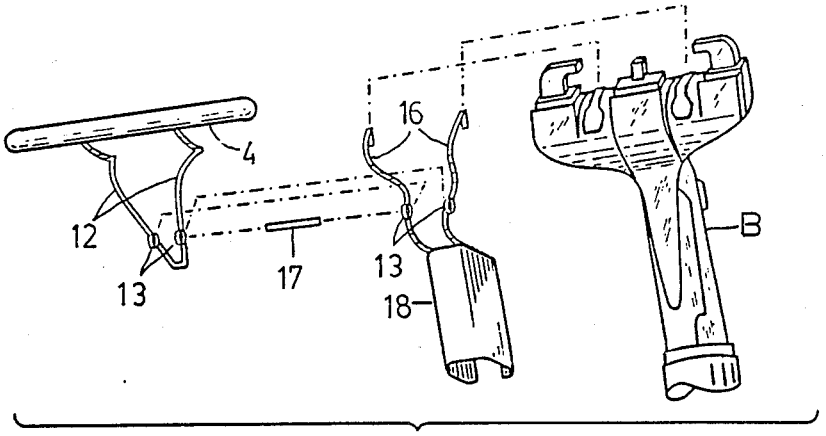
FIG. 1 is an exploded perspective view, showing the components of the razor adaptor in related positions to each other and to a razor handle (B) to which the adaptor is to be hingedly attached.

Refering to the drawings, it will be seen, that the illustrative rasor adaptor (Fig. 1,2,3) comprises a skin stretching bar (4) having a highly frictional fluted surface, coated with rubber or vinyl, extending outwards in a spaced manner below and parallel to the blade assembly (A) pivotally connected to the handle (B) of a razor system to constantly stretch and arch the skin ahead of said assembly (A) to lift up the hairs within their natural hollows to suit the blade(s) for a better shaving; said bar (4) is fixed symmetrically to the free ends of an interconnecting, V-shaped arms (12) sharing a pair of hinge eyelets (13) at a suitable point close to its lower end - as specified later; a flat, springy material pair of parallel arms constituting a bracket (16) perpendicularly fixed to the top corners of clamp (18) embracing said handle (B) to attach the adaptor to said system; said bracket (16) is arched from said clamp (18) parallel one to another toward the connecting upper portion of said handle (B) and sharing a pair of hinge eyelets (13) at its crossing point on an imagi-

UNITED STATES PATENT AND TRADEMARK OFFICE

CERTIFICATE OF CORRECTION

PATENT NO. : 4,845,846

DATED : 7/4/89

INVENTOR(S) : Laslo B. Sinka

It is certified that error appears in the above-identified patent and that said Letters Patent is hereby corrected as shown below:

native line equally dividing the angle between said upper portion and said handle (B) at a suitable location which is slightly closer to the handle (B) and to its upper portion than to the original point of said dividing line. Fr om this point, the arms - forming said bracket (16) - are gradually changing their direction - suitably away from each other - toward said upper portion to follow its contour to perch on its edge in the associated channels between the flanges to secure a firm position for the adaptor; said hinge eyelets (13) on said V-shaped arms (12) fit inside of their counterparts (13) of bracket (16) and connected together by a hinge pin (17). On this hinge (13) said bar (4) could be moved away from said cartridge (A) down to said handle (B) when said bar (4) is not needed. For example: shaving under the nose upward, trimming or in some medical shaving. For this purpose the distance of said hinge eyelets (13) from the lower end of said V-shaped arms (13) is slightly longer than from said handle (B) and from said upper portion to lock said bar (4) into either an operating or a resting position by using the springy action of said bracket (16) and slightly shorter than the distance of said hinge eyelets (13) from the origin of said dividing line to provide an adequate clearance for the movement of It is certified that error appears in the above-identified patent and that said Letters Patent is hereby corrected as shown below:

said arms (12) during flipping said bar (4) up and down - as illustrated in Fig. 2 by the dotted lines. The pressure distribution control is manual for personal preferences.

To hingedly attach the above described adaptor to one type of the various shape disposable razor systems, a modified embodiment may be used - as illustrated in Figure 4 - which comprises an arm (12) fixed to said bar (4) and attached by a hinge (13) and a hinge pin (17) to a clamp (18) embracing said handle (B) to couple the adaptor to said system. Said arm (12) and said clamp (18) have fins (19)(Fig.4,5) facing said handle (B) to fit into the grooves (20) in said handle (B) and to lock the adaptor into a firm position on said handle (B). The way of flipping said bar (4) up and down is illustrated by the dotted line in Figure 4. This modified version of the adaptor could also be made entirelly of plastic and - because of low production costs - one adaptor could simply be droped into a package of disposable system for promotion alone.

Arm (12) (Fig.4) could be formed to be hinged directly to said handle

UNITED STATES PATENT AND TRADEMARK OFFICE

CERTIFICATE OF CORRECTION

PATENT NO. : 4,845,846

DATED : 7/4/89

INVENTOR(S) : Laslo B. Sinka

It is certified that error appears in the above-identified patent and that said Letters Patent is hereby corrected as shown below:

(B) having openings at a suitable point for this purpose. (Not illustrated.)

---

Signed and Sealed this

Eighth Day of January, 1991

*Attest:*

HARRY F. MANBECK, JR.

*Attesting Officer*

*Commissioner of Patents and Trademarks*